US006350000B1

(12) United States Patent
Van Benthem et al.

(10) Patent No.: US 6,350,000 B1
(45) Date of Patent: Feb. 26, 2002

(54) ASSEMBLY FOR AN AIR CONDITIONER CABINET

(75) Inventors: Marinus Johannes Antonius Van Benthem, Etten-Leur; Philippus Johannes Maria Bleijs, Tilburg, both of (NL)

(73) Assignee: Holland Heating B.V., Waalwijk (NL)

( * ) Notice: Subject to any disclaimer, the term of this patent is extended or adjusted under 35 U.S.C. 154(b) by 0 days.

(21) Appl. No.: 09/486,296

(22) PCT Filed: Sep. 8, 1998

(86) PCT No.: PCT/NL98/00516

§ 371 Date: Feb. 23, 2000

§ 102(e) Date: Feb. 23, 2000

(87) PCT Pub. No.: WO99/13273

PCT Pub. Date: Mar. 18, 1999

(30) Foreign Application Priority Data

Sep. 8, 1997 (NL) ..... 1006974

(51) Int. Cl.[7] ..... A47B 77/08

(52) U.S. Cl. ..... 312/236; 312/257.1

(58) Field of Search ..... 312/236, 400, 312/401, 406.2, 140, 263, 265, 265.2, 265.1, 108, 111, 257.1; 220/592.1, 592.01, 592.02, 592.09; 52/736.3, 405.4, 407.3

(56) References Cited

U.S. PATENT DOCUMENTS

| | | | | |
|---|---|---|---|---|
| 3,527,011 A | | 9/1970 | Bloom et al. | 52/204.593 |
| 3,937,133 A | * | 2/1976 | Bertin et al. | 312/111 X |
| 4,691,970 A | * | 9/1987 | Neri | 312/140 X |
| 4,782,637 A | * | 11/1988 | Eriksson et al. | 312/257.1 X |
| 4,968,105 A | * | 11/1990 | Schaars | 312/140 |

FOREIGN PATENT DOCUMENTS

| | | |
|---|---|---|
| DE | 2178014 | 4/1993 |
| EP | 427626 A1 | 11/1990 |
| EP | 468597 A1 | 7/1991 |
| GB | 2264165 A | 2/1992 |
| WO | WO9424493 | 10/1994 |

* cited by examiner

*Primary Examiner*—James O. Hansen
(74) *Attorney, Agent, or Firm*—William W. Habelt

(57) ABSTRACT

Assembly of parts for mutually joining one or more panels of an air conditioning cabinet, the assembly comprising:

a wall and one or more profile parts joined to this wall which extend therefrom, which profile parts are joinable with a cabinet panel in such a way that the wall makes no contact with sides of the panel forming the inner wall of the air conditioning cabinet, wherein the wall and the profile parts are chosen such that a low heat transfer coefficient is providable and such that condensation within and exterior to the cabinet is substantially avoidable.

9 Claims, 10 Drawing Sheets

ASSEMBLY FOR AN AIR CONDITIONER CABINET

FIELD OF THE INVENTION

The present invention relates to an assembly for the mutual coupling of panels of an air conditioning cabinet and to an air conditioning cabinet comprising such an assembly.

BACKGROUND OF THE INVENTION

A disadvantage of known air conditioning cabinets such as that described in the European patent application No. 91201946.0 is that condensation can occur within such cabinets when these are used under humid conditions, such as exist in South East Asian countries.

SUMMARY OF THE INVENTION

An important object of the present invention is to substantially obviate this disadvantage.

The present invention accordingly provides an assembly of parts for mutually joining one or more panels of an air conditioning cabinet, the assembly comprising:

a wall and one or more profile parts joined to this wall which extend therefrom, which profile parts are joinable with a cabinet panel in such a way that the wall makes no contact with sides of the panel forming the inner wall of the air conditioning cabinet, wherein the wall and the profile parts are chosen such that a low heat transfer coefficient is providable and such that condensation within and exterior to the cabinet is substantially avoidable.

With this assembly, there is a clear reduction in condensation in comparison with known air conditioning cabinets.

Since the wall preferably comprises an inner wall part and an outer wall part with a spacing therebetween, insulation means which are preferably mounted between the wall and the profile part and whereby the wall and the profile part preferably have differing heat transfer coefficients, the assembly functions as an effective cold bridge in order to prevent condensation in the cabinet. The wall can be substantially L-formed in shape and is preferably extruded from aluminum in order to be light in weight.

Since the assembly preferably serves in a frame of an air conditioning cabinet, the assembly is, in its assembled form, preferably square.

According to a second aspect of the present invention, there is provided an air conditioning cabinet, comprising the above connection assembly.

According to a third aspect of the present invention, there is provided a door for an air conditioning cabinet.

BRIEF DESCRIPTION OF THE DRAWINGS

Further advantages, characteristics and details of the present invention will be clarified with respect to the specific description of preferred embodiments thereof, with reference to the accompanying figures, wherein.

DETAILED DESCRIPTION OF THE INVENTION

Figure 1:
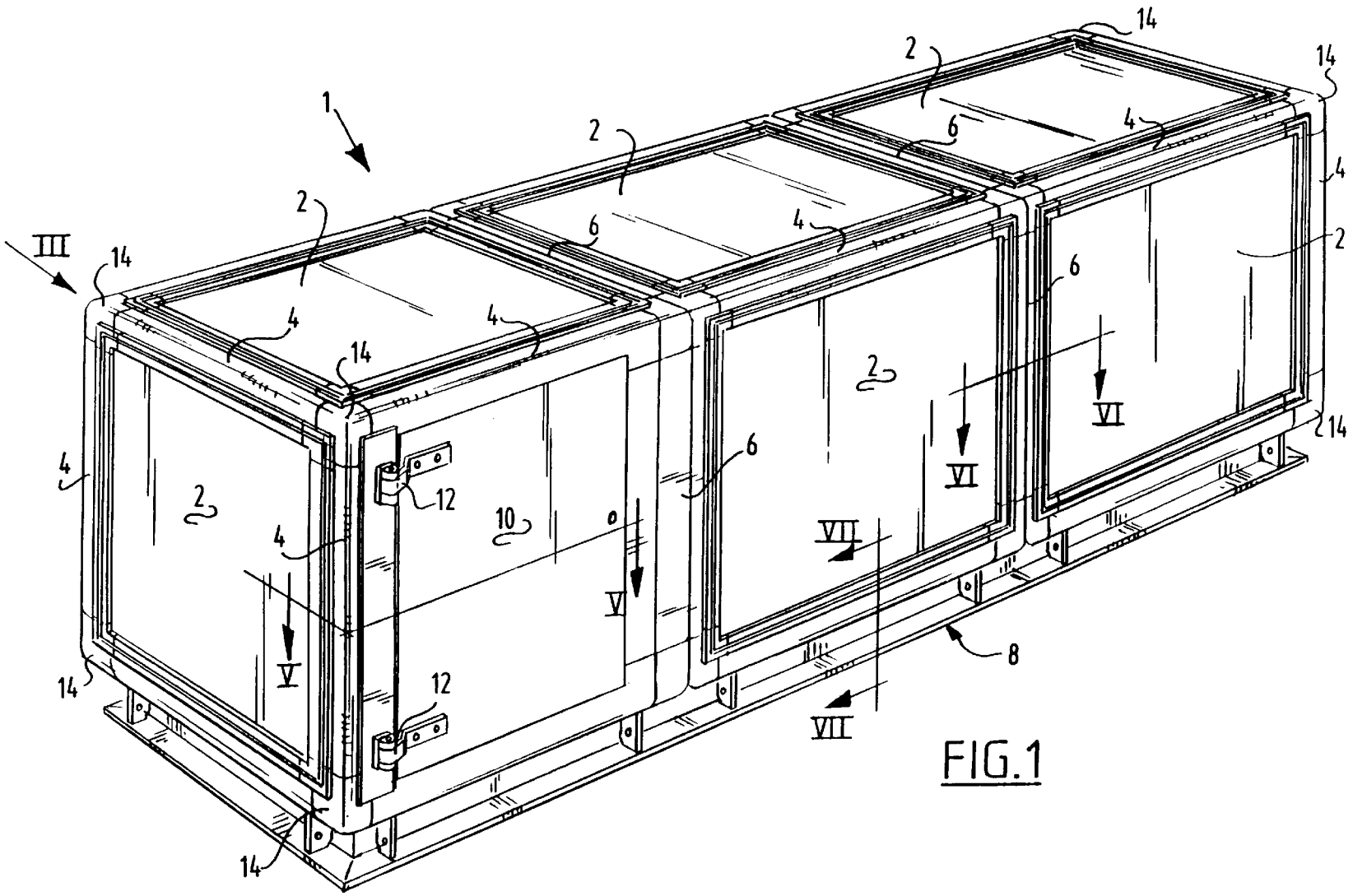
FIG. 1 shows a perspective view of an air conditioning cabinet according to the present invention.

An air conditioning cabinet 1 (FIG. 1), wherein apparatus (not shown) such as a ventilator, filters, and possibly an air humidifier and the like are mounted, comprises panels 2, corner columns 4 and intermediate columns 6. An underframe 8 comprises continuous lying profiles. The cabinet 1 further comprises a door 10 mounted on the cabinet 1 by means of two hinges 12.

Figure 3:
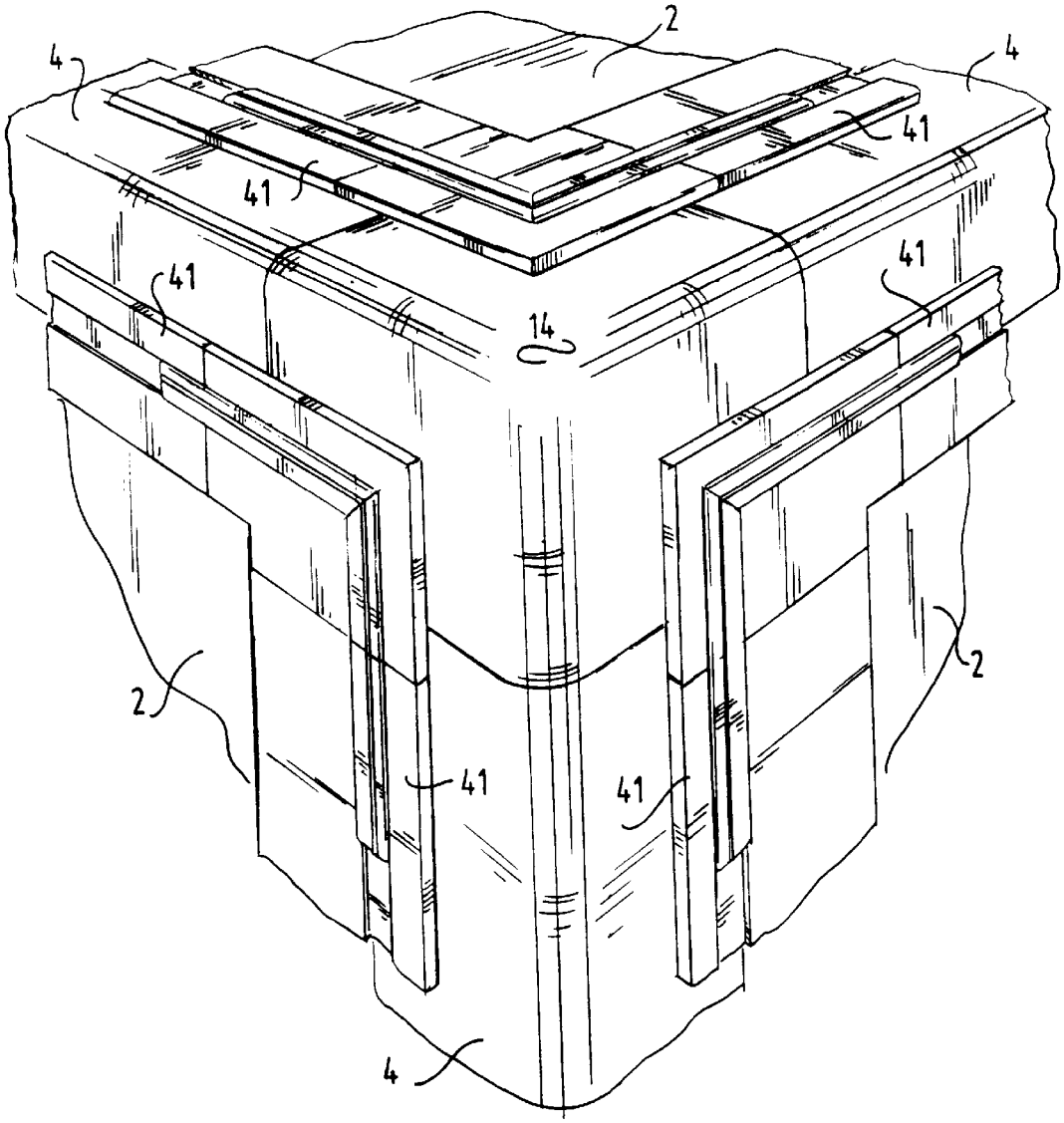
FIG. 3 shows a perspective view of a corner of the cabinet from FIG. 1 as seen in the direction of arrow III.

The corner columns 4 are mutually connected by means of corner points 14, as is also shown in FIG. 3.

Figure 2:
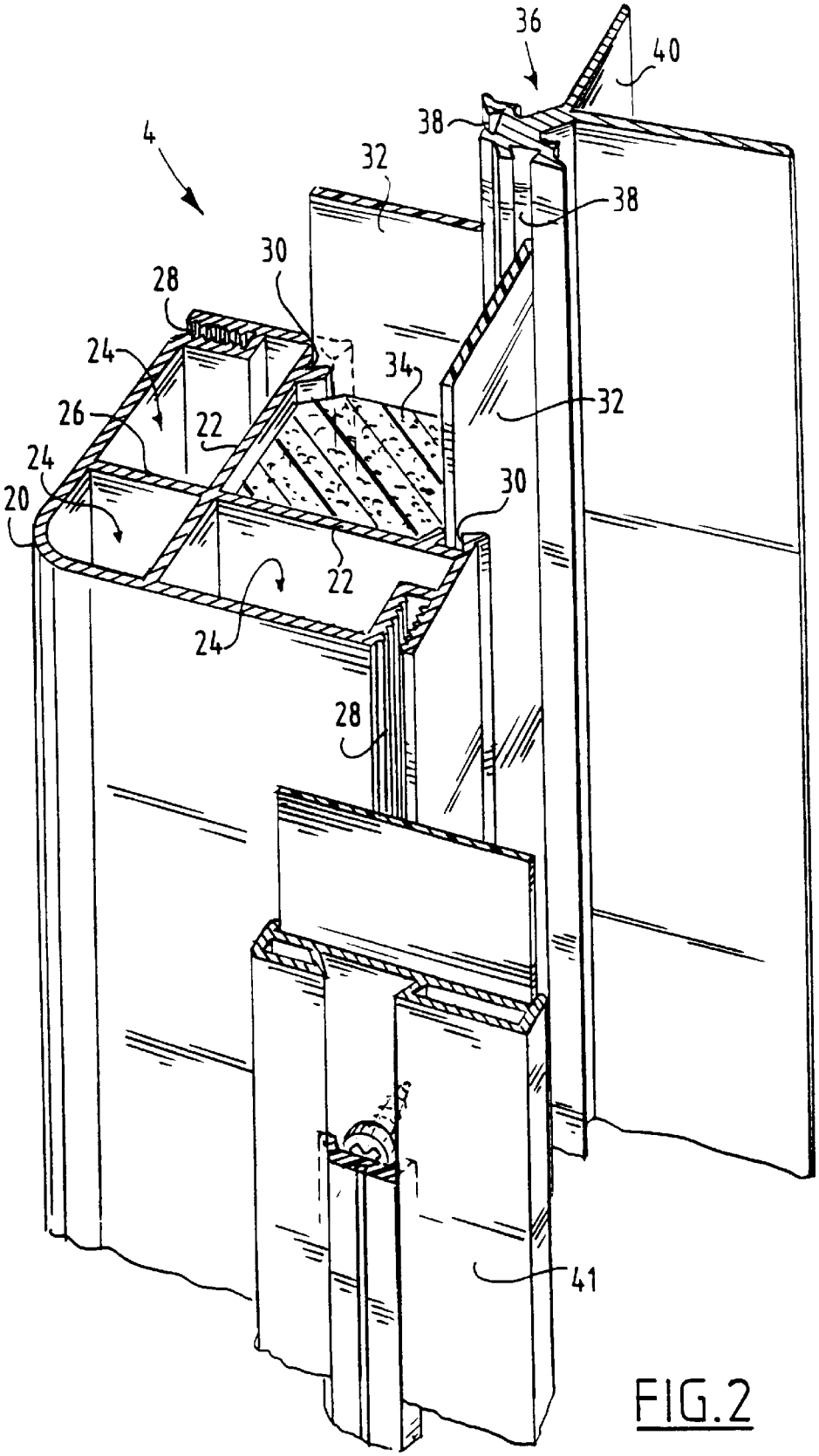
FIG. 2 shows a perspective view of the assembly according to the present invention.

The panel connecting assembly (columns) 4 is built up from an aluminum wall 18 with an outer wall part 20 and an inner wall part 22 (FIG. 2). These wall parts 20, 22 have a spacing 24 therebetween and are separated by means of four struts 26.

The wall 18 is L-shaped in cross section and is provided with screw canals 28 for securing screws.

The inner wall part 22 is provided with profile channels 30 for gripping plastic profiles 32 which extend from the wall 18 inwards in order to provide the columns 4 with a square form in cross section. Between the inner wall part 22 and these two plastic profiles 32 a polyurethane insulating foam 34 is provided.

These profiles 32 are also joined to an extended Y-shaped panel connection 36, provided with two locking channels 38 for locking the plastic profiles 32 into position.

Figure 5:
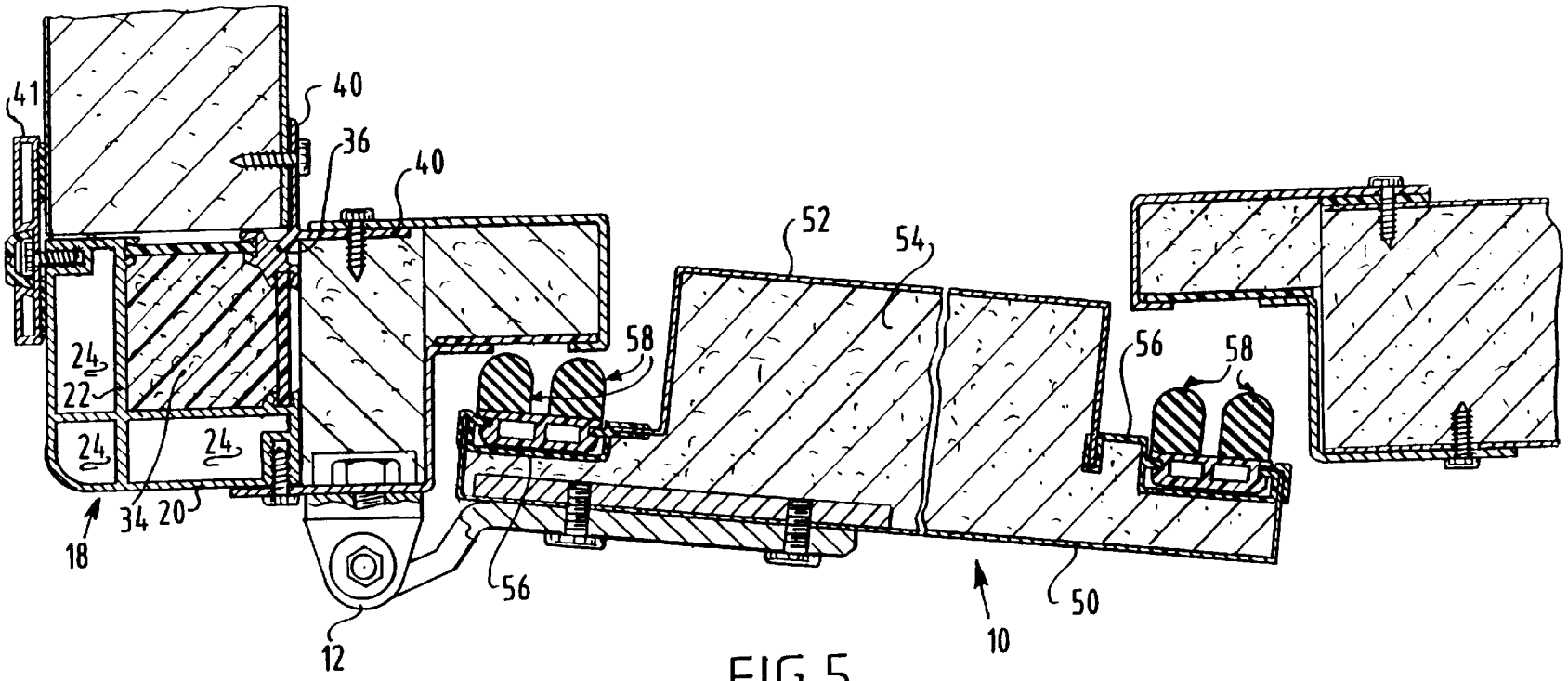
FIG. 5 is a cross section over line V—V from FIG. 1.

Flanges 40 extend from this panel connection 36, these flanges which can be securely screwed to the air conditioning cabinet panels, as is shown in FIG. 5.

An aluminum cover strip 41 is screwed to the wall 18, in order to cover the connection between the columns 4 and subsequent cabinet panels.

Figure 4:
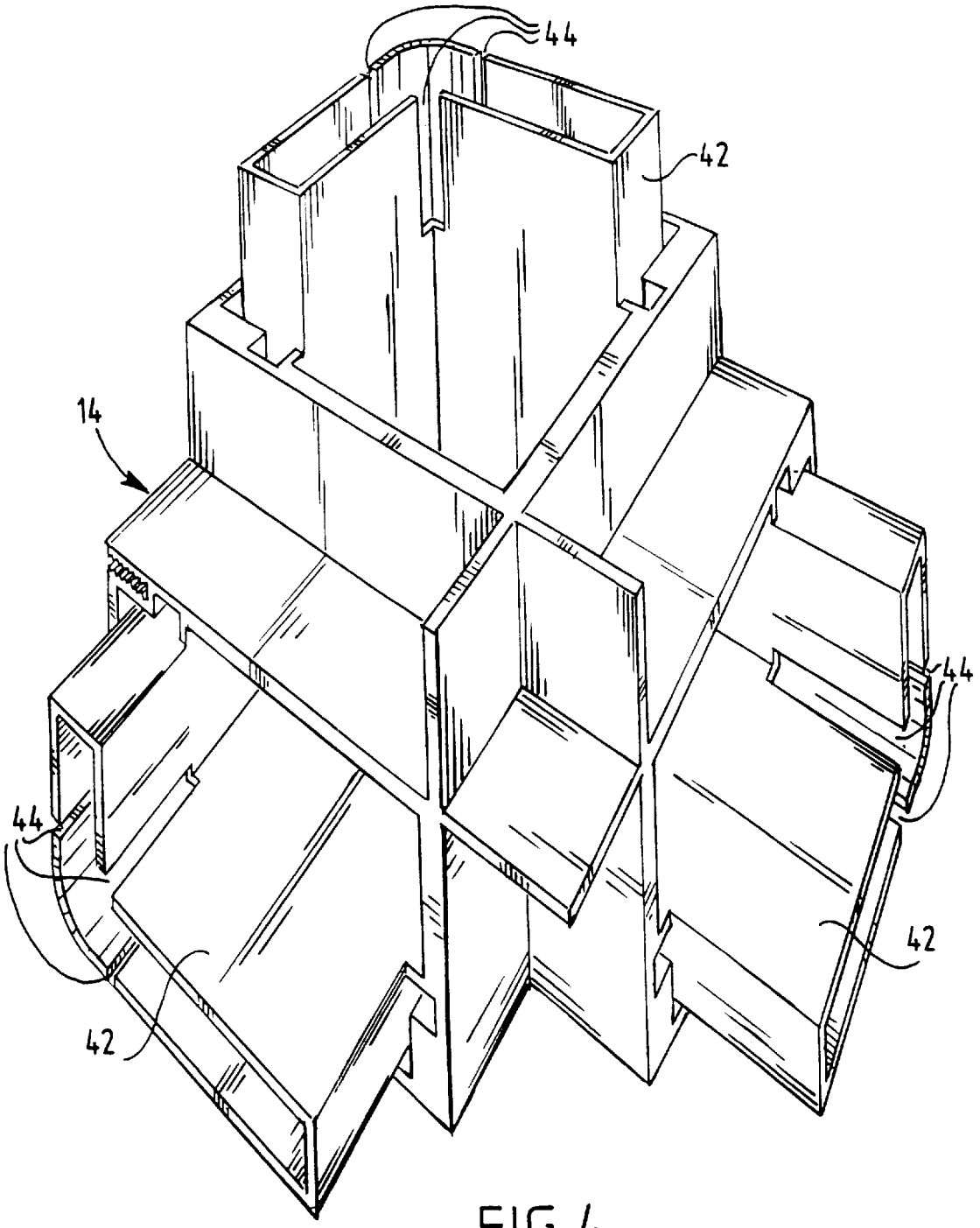
FIG. 4 shows a perspective view of the corner from FIGS. 1 and 3 as seen from the interior thereof.

The corner points 14 each have three extending leg parts 42 (FIG. 4), which are provided with recesses 44 for the wall struts 26, the legs 42 which pass in the spacing 24 of the columns 4 in order to join the columns 4 together (see FIG. 1).

The door 10 has an outer wall 50 and an inner wall 52, where between polyurethane foam 54 is mounted (FIG. 5).

An extended U-shaped connecting piece 56 connects the inner wall 52 with the outer wall 50 and also serves as a support for two rubber insulating door sealings 58.

The door 10 is mounted on the cabinet by means of hinges 12.

Figure 6:
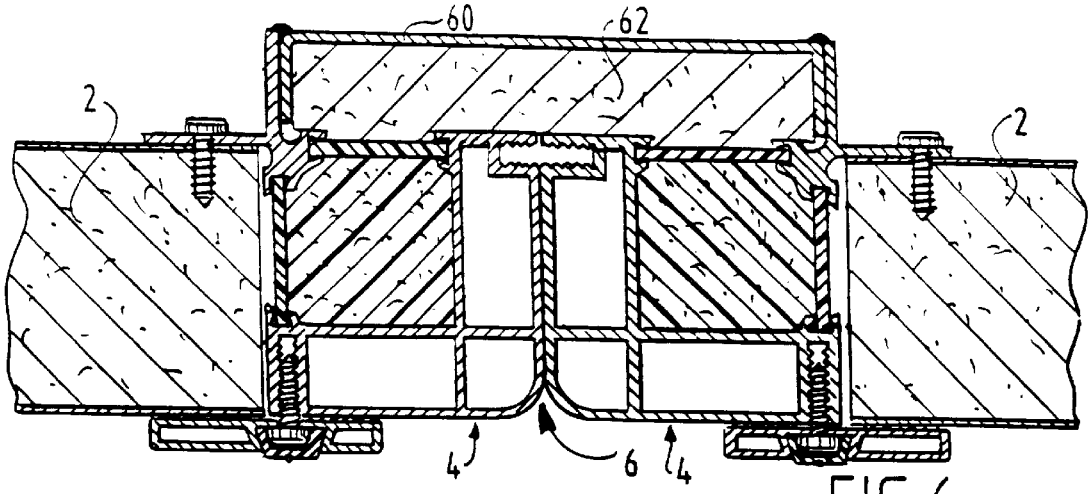
FIG. 6 shows a cross section over line VI—VI from FIG. 1.

In order to join together two panels lying in the same plane, two columns 4 serve as an intermediate column 6 to be joined together by means of a joining plate 60 as shown in FIG. 6. Polyurethane foam 62 is provided between this joining plate 60 and the columns 4.

Figure 7:
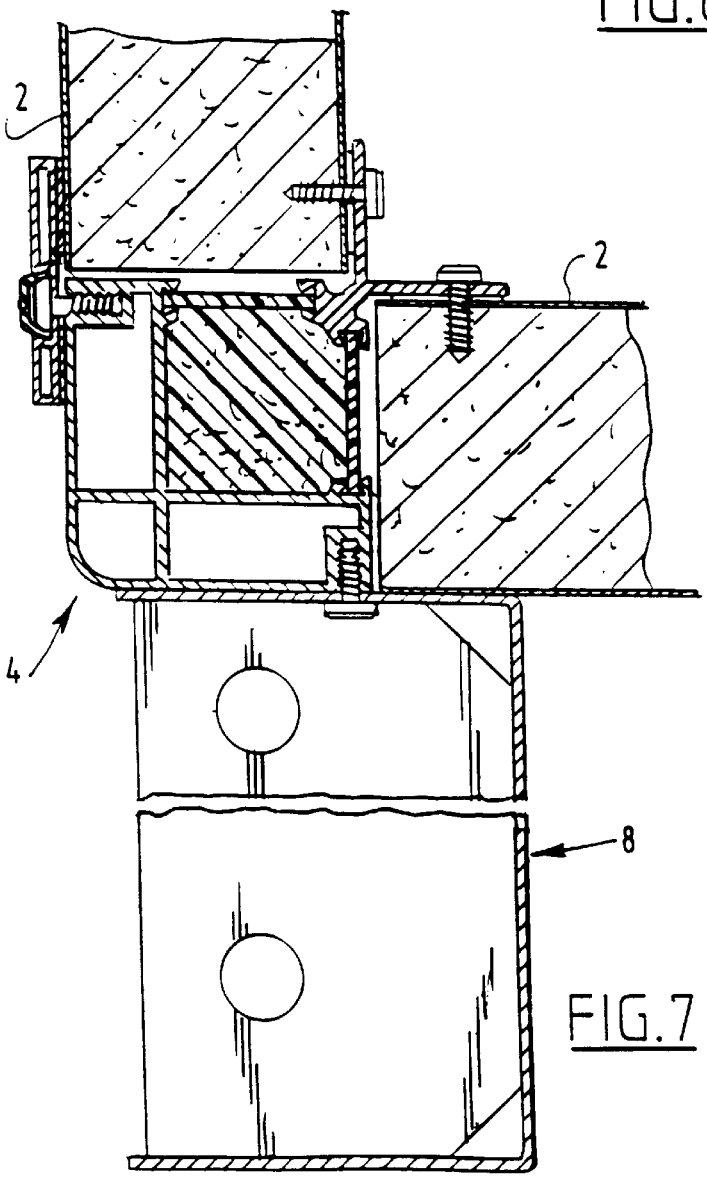
FIG. 7 shows a cross section over line VII—VII from FIG. 1.

The underframe 8 (FIG. 7) is secured to the air conditioning cabinet by means of screws secured in a screw channel of a column 4.

Figure 8:
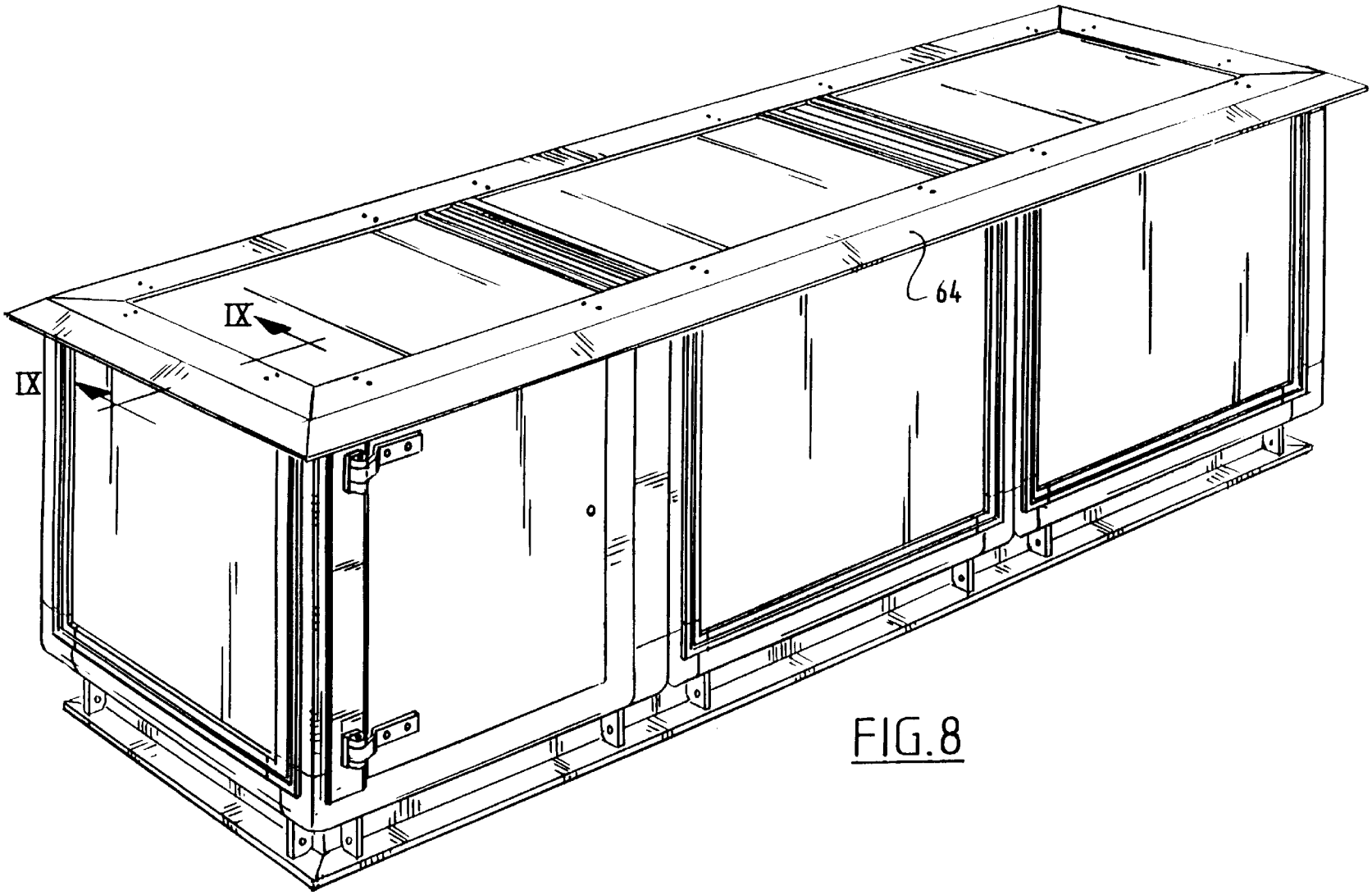
FIG. 8 shows a perspective view of a second embodiment of an air conditioning cabinet.
Figure 9:
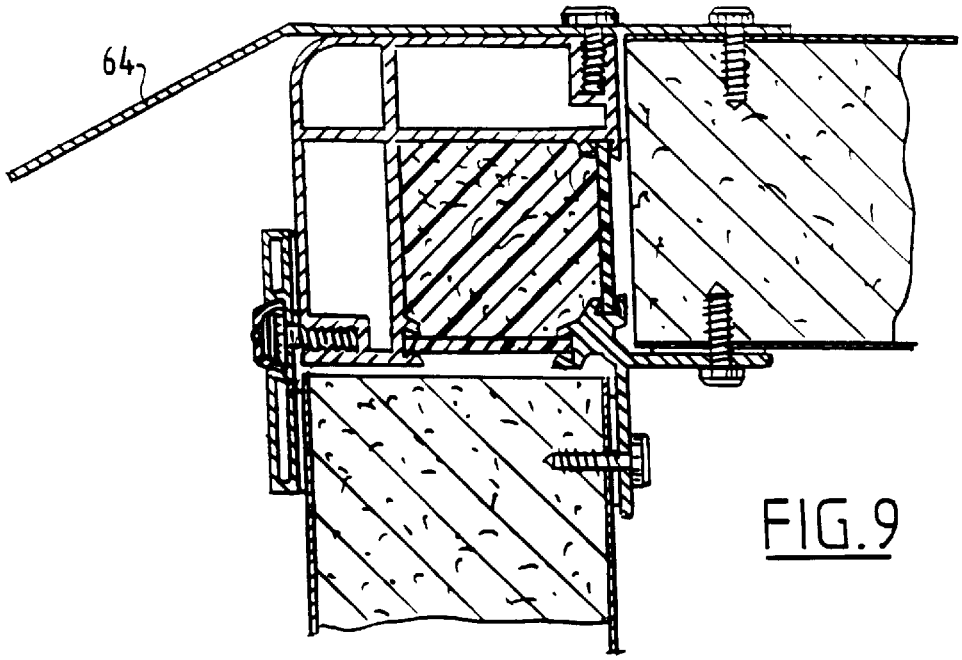
FIG. 9 shows a cross section over line IX—IX from FIG. 8.

FIG. 8 shows an embodiment of the air conditioning cabinet with an overhanging lip 64 mounted on the upper side of the cabinet, which serves as protection, for example against rain and such like. This overhanging lip 64 is secured by means of screws to a panel and a column (see FIG. 9).

Figure 10:
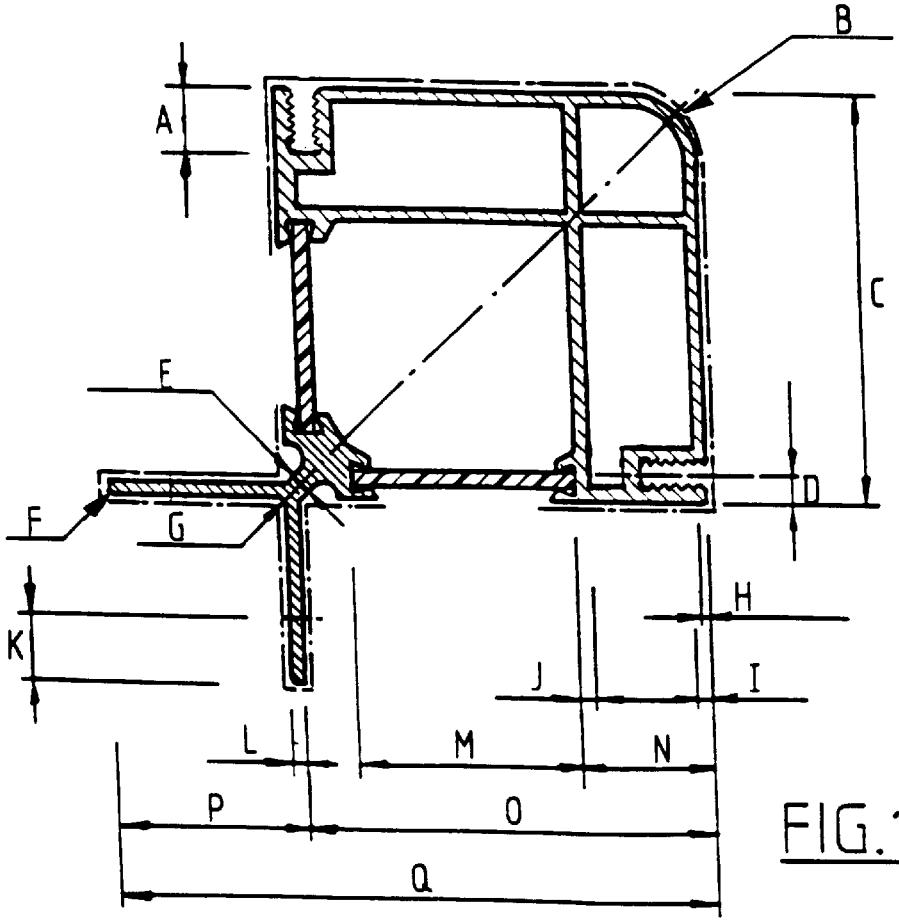
FIG. 10 shows a cross section of the column from FIG. 2.

The cross section of the column 4 (FIG. 10) has the following dimension:

| |
|---|
| A = 11 mm |
| B = 10 mm |
| C = 62 ± 0,3 mm |
| D = 5 mm |
| E = 3 mm |
| F = 1 mm |
| G = 1 mm |
| H = 1,5 mm × 45° |
| I = 2 mm |
| J = 1,8 mm |
| K = 10 mm |
| L = 2 mm |
| M = 32 mm |
| N = 20 mm |
| O = 60 ± 0,3 mm |
| P = 30 mm |
| Q = 90 mm |

Figure 11:
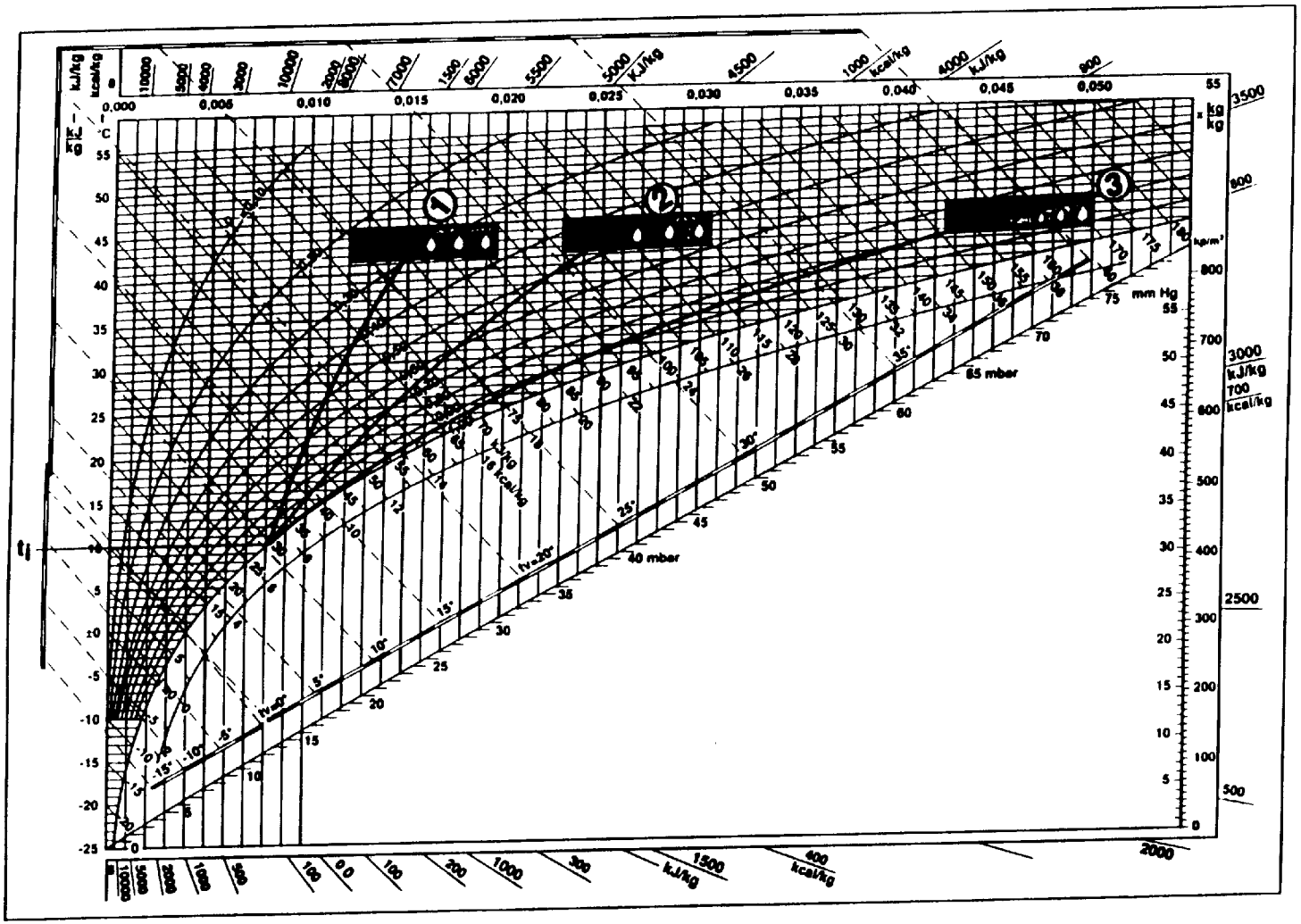
FIG. 11 and 12 are condensation graphs resulting from measurements taken from air conditioning cabinets wherein 1 and 2 are reference measurements obtained from known cabinets and wherein 3 refers to measurements obtained for the cabinet according to the present invention.
Figure 12:
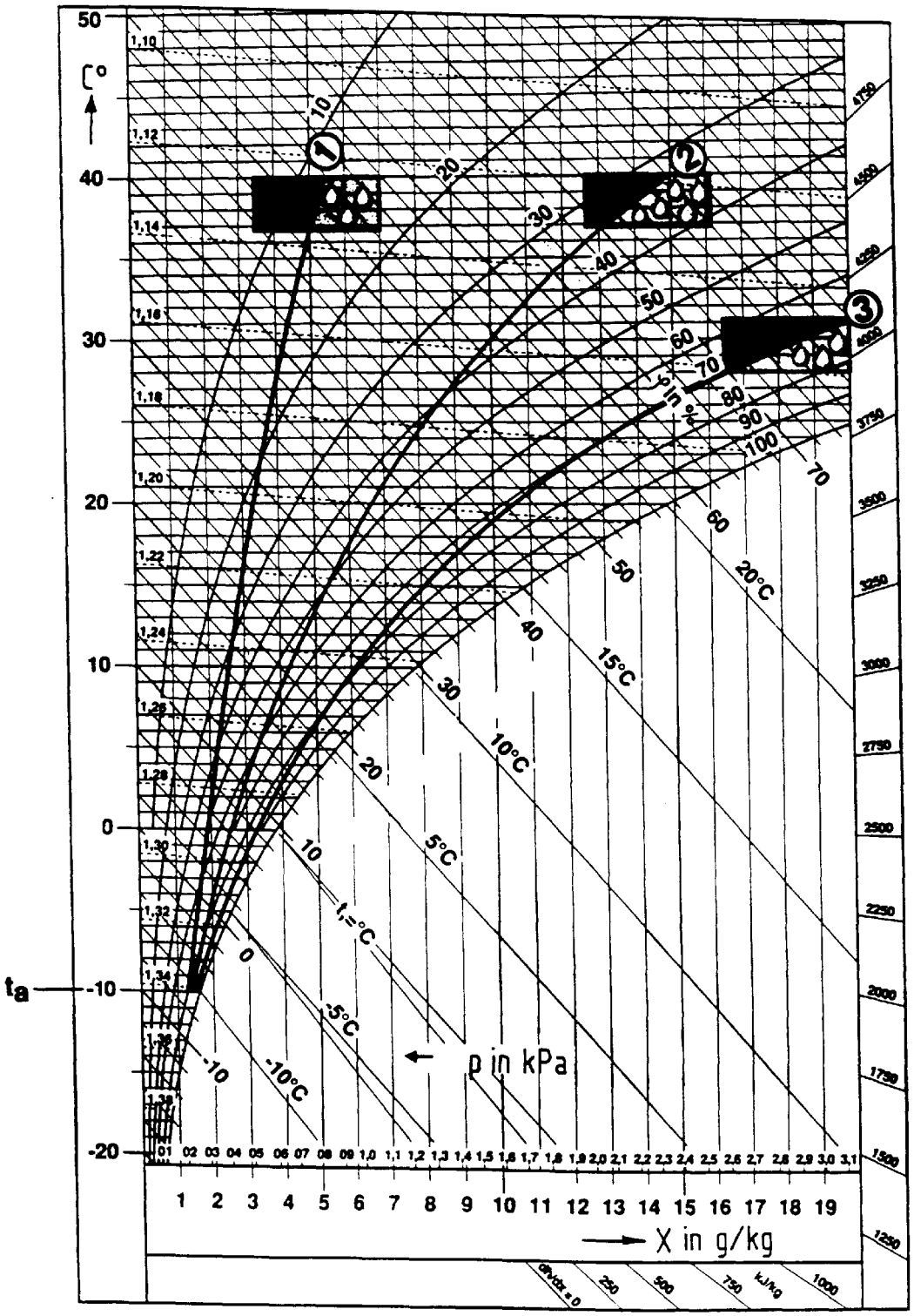

The inventors have measured the air conditioning cabinet according to the present invention, for both external and internal condensation under varying conditions, wherein FIG. 11 shows the level of external condensation and FIG. 12 the level of internal condensation of the air conditioning cabinet.

A number of other measured parameters of the air conditioning cabinet according to the present invention as measured by the inventors are as follows:

| | |
|---|---|
| Heat transfer coefficient | $0,6\frac{W}{m^2 K}$ |
| Thermal Bridging | 0.87 |
| Leaking air from the cabinet, standard | $<0,003*P^{0.65}$ |

The invention is not limited to the above description, the requested rights are rather determined by the following claims.

What is claimed is:

1. Air conditioning cabinet comprising:

an underframe having one or more continuous, lying frame assemblies;

one or more panels securable to the underframe and to which one or more of the frame assemblies are securable; and to which a subsequent panel is securable; and a panel connecting assembly, said assembly including a wall having an outer wall part and an inner wall part, said wall being substantially L-shaped in cross-section; said inner and outer wall parts spaced apart by means of an insulation material free first spacing; and a plurality of securing profile parts joined to the wall which extend therefrom, said profile parts being joinable with said one or more panels, whereby said securing profile parts are joined to said wall such that a combination of said securing profile parts and the inner and outer wall parts are substantially square in cross-section, whereby the inner wall part and the securing profile parts enclose a second spacing, said second spacing being substantially filled with insulating material so as to provide a low heat transfer coefficient, whereby condensation within and exterior to the cabinet is substantially avoidable.

2. Cabinet according to claim 1 wherein the wall and the profile parts have differing heat transfer coefficients.

3. Cabinet according to claim 1 wherein the wall is made of aluminum.

4. Cabinet according to claim 1 wherein the profile parts are made of synthetic material.

5. Cabinet according to claim 1 wherein the insulating material comprises polyurethane foam.

6. Air conditioning cabinet according to claim 1, further comprising a door, having:

an outer wall, an inner wall, insulation means, mounted between these walls; and a sealing member extending from the door to contact a panel when the door is closed, wherein the door is assembled such that a low heat transfer coefficient is providable, so that condensation within and exterior to the cabinet is substantially avoidable.

7. Cabinet according to claim 6, further comprising securing means for securing the sealing member to the door.

8. Cabinet according to claim 7, wherein the door has substantially the same thermal conductivity as the assembly.

9. Cabinet according to claim 8, wherein the door is mounted on the cabinet by means of a hinge.

* * * * *